United States Patent [19]

Young

[11] Patent Number: 4,641,882

[45] Date of Patent: Feb. 10, 1987

[54] ORTHOPEDIC APPLIANCE

[76] Inventor: John Young, 216 Crystal Lake Rd., Algonquin, McHenry County, Ill. 60102

[21] Appl. No.: 260,905

[22] Filed: May 6, 1981

[51] Int. Cl.[4] ..... A47C 4/52

[52] U.S. Cl. ..... 297/183; 297/4; 297/5; 297/195

[58] Field of Search ..... 297/183, 195, 4, 5, 297/6; 272/70.3, 144, 134; 128/70 R, 80 H; 135/65, 66, 67, 72, 73, 75; 3/4

[56] References Cited

U.S. PATENT DOCUMENTS

| | | | |
|---|---|---|---|
| 671,638 | 4/1901 | Slagle | 297/4 |
| 1,307,058 | 6/1919 | McGrath | 135/67 X |
| 2,099,345 | 11/1937 | Olszanowski | 297/4 |
| 2,643,843 | 6/1953 | Brown | 248/156 |
| 3,272,210 | 9/1966 | Boruvka | 135/72 X |
| 3,759,511 | 9/1973 | Zinkin et al. | 272/134 X |

FOREIGN PATENT DOCUMENTS

| | | | |
|---|---|---|---|
| 44137 | 9/1910 | Austria | 135/66 |
| 1066000 | 9/1959 | Fed. Rep. of Germany | 297/4 |
| 1552131 | 11/1968 | France | 128/80 |

*Primary Examiner*—James T. McCall

*Attorney, Agent, or Firm*—James T. FitzGibbon; Angelo J. Bufalino

[57] ABSTRACT

An orthopedic appliance, such as a crutch, adapted to support the body of an injured or handicapped person without the use of his arms and hands. The crutch is adapted to be readily movable with the person and comprises a principal frame assembly having a lower portion adapted to engage and rest upon a travelled surface in position of use, a seat assembly disposed at the other end of the frame and forming body support means for a person. The crutch has at least one handle extending radially outwardly from said frame and spaced downwardly apart from said seat assembly, and it is positioned relative to said frame so as to be able to be grasped by said person while said person is supported by said seat. Preferably the appliance also includes a foot support peg assembly near the bottom, a clip or the like for securing the ankle to the bottom of the frame and a height adjustment assembly.

11 Claims, 6 Drawing Figures

ORTHOPEDIC APPLIANCE

The present invention relates generally to orthopedic appliances, and more particularly to a so-called "armless crutch" or the like intended to enable a person having an injured leg, foot or ankle to move about, and more importantly, to continue to work effectively with his hands and arms while utilizing the appliance.

While there are available a great number of orthopedic applicances, such as crutches, canes and the like, which are highly satisfactory in use for enabling injured persons merely to move about, there are many occasions wherein a person who has an injured foot, ankle or leg is otherwise able to work and wishes to work as well as merely moving about, but cannot work in a satisfactory manner using known crutches or braces.

Thus, while persons who are not required to move continually from place to place, and who have an injured leg, for example, may move to their work station by using a cane or crutches and then be seated, there are other persons whose work requires them to assume a wide variety of working positions in order to accomplish the jobs for which they are employed. Such persons, for example, autobody and fender repair men, are required to perform tasks which include grinding, polishing, soldering, spot welding and filling parts of automobile bodies, including surfaces which extend virtually from ground level to levels at or above the height of a man standing. Consequently, workers such as this cannot accomplish their jobs while seated in a chair or the like, because their work requires bending and stooping not compatible with being seated in a chair, and because front to rear or back and forth mobility is required which is not consistent with operating in a fixed level, seated position.

By the same token, while crutches and the like form good support for a person in the standing or near standing position, it is well known that where crutches are used, the body must be supported by the hands and arms of the user rather than permitting the saddle or upper support portions of the crutch to engage the arm pits directly. This is because resting the body weight directly on the crutch saddle will pinch the nerves lying on the lower surfaces of the arm pits, with the possibility of temporary or even permanent injury. Accordingly, a person using conventional crutches and desiring to avoid further injury requires the use of one or both of his hands merely to stay erect while using the crutches.

According to the present invention, an apparatus is provided which enables a person having an injured foot or leg to move about easily, to support himself without straining the injured body member, and at the same time to leave both hands free for useful work. In view of the shortcomings of prior art orthopedic or post injury devices, such as crutches, canes, walkers and the like, it is an object of the present invention to provide an improved body support assembly.

Another object of the invention is to provide an improved body support unit which is simple to manufacture and easy to use.

A still further object of the invention is to provide a support unit for a person having an injured foot or leg, which unit will enable the user to move about freely and, when in a stationary position, use his hands and arms freely for accomplishing a task at hand rather than using his arms and hands merely to support his body.

Another object of the invention is to provide an orthopedic or body support device which does not require the use of hands and arms while the appliance is being used to support the body.

A still further object of the invention is to provide a simplified body support device for an injured person, with such device including a main support assembly having a lower portion adapted to engage and rest upon a traveled surface in position of use, a seat assembly disposed at the other end of said support assembly, and means fixed in relation to said support assembly for supporting and positioning the leg and foot of the patient.

A still further object is to provide a crutch or like support assembly which includes a main frame portion, a seat disposed atop the main frame portion, means at the bottom of said main frame for engaging a traveled surface, a foot peg extending radially outwardly from said main frame, and one or more hand holds extending outwardly from the upper portion of the frame assembly beneath the seat and adapted to be grasped by the user when transporting himself and the appliance as a unit from place to place.

Another object of the invention is to provide an improved crutch and body support unit which will add substantial support to the body of an injured person but which will permit the person to use both his hands and arms for working or otherwise without the need for using them to support his body.

A still further object of the invention is to provide a simplified, unitary crutch assembly which includes a seat, one or more handles adapted to be grasped by the user, a clip adapted to secure the leg of the person to the crutch and a foot peg unit attached to forming a part thereof for supporting the foot or ankle of the injured person so as to eliminate the need for placing weight thereon.

Another object is to provide an appliance as described above, including which one aspects includes adjustable foot pegs and clips, whereby it may fit a variety of individuals.

An even further object is to provide a crutch which does not require the space traversed by the user to be wider than a conventional walking space and which is, thereofre, useful in shop, industrial, or other crowded areas.

A further object is to provide a crutch or like which provides improved safety, particularly on stairways or the like wherein one hand of the user may be free to hold the hand rail while the other hand can be used to manipulate the crutch.

Another object is to provide a crutch which, in use, provides an increased rate of safe travel on stairways.

The above and other objects and advantages of the invention are achieved in practice by providing an armless crutch assembly which includes a main support frame, a seat situated at the top thereof, a lower end adapted to engage a traveled surface, at least one hand hold assembly positioned closely adjacent the seat, and means fixed to the support unit for supporting a lower portion of the user's body.

The exact manner in which the above and other objects and advantages of the invention are achieved in practice will become more clearly apparent when reference is made to the following detailed description of the preferred embodiment of the invention set forth by way of example and shown in the accompanying drawings, in which like reference numbers indicate corresponding parts throughout.

DESCRIPTION OF THE PREFERRED EMBODIMENTS OF THE INVENTION

Figure 1:
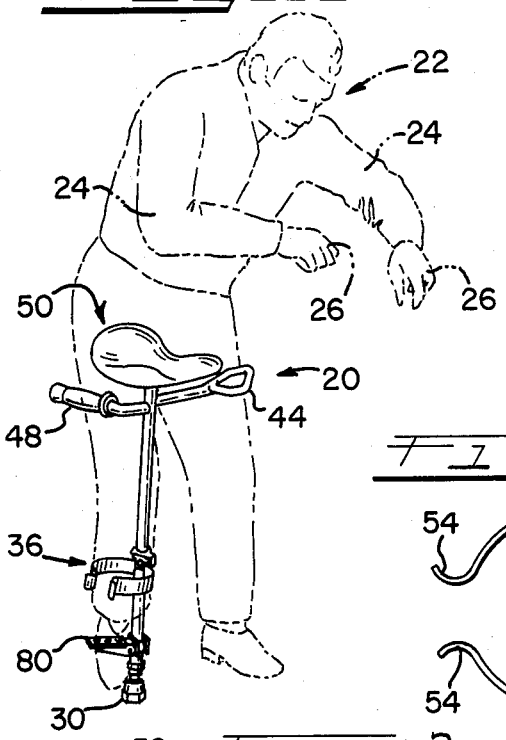
FIG. 1 is a perspective view of the orthopedic appliance of the present invention showing a user thereof in phantom lines.

Referring now to the drawings in greater detail, FIG. 1 shows an appliance 20 made according to the invention being used by a person generally designated 22 and shown to be using his arms and hands 24,26 in useful work while seated atop the appliance of the invention.

Figure 2:
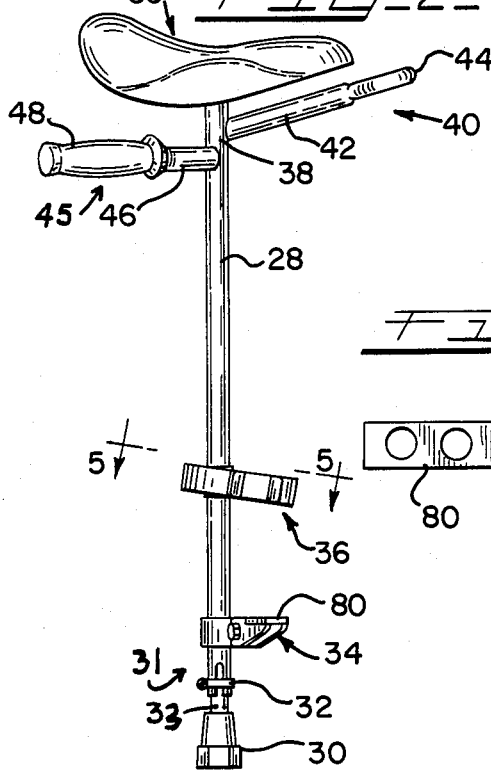
FIG. 2 is a side elevational view, on an enlarged scale, of the appliance of the invention.

Referring now to FIG. 2, the invention is shown to be embodied in a crutch assembly generally designated 20 and shown to include principal mounting means in the form of a generally vertically extending frame tube 28 and having secured to the bottom thereof in coaxially arranged relation a tip portion 30 adapted to rest upon a floor or other traveled surface. Spaced upwardly from the lower portion 31 of the frame 28 is a foot rest assembly generally designated 34 to which detailed reference will be made further.

Spaced somewhat above to lower end of the frame tube 28 is a clip assembly generally designated 36 to which detailed reference will also be made elsewhere. Extending radially outwardly from the upper portions 38 of the frame tube 28 are a forwardly directed handle assembly 40 and an angularly outwardly extending rear or side han-dle assembly 45.

The forward handle assembly 40 includes a stem or tube 42 and a closed bight or hand grip portion 44. The secondary or rear handle assembly 45 also includes a stem or tube 46 which is offset (FIG. 4) from the frame tube 28 and which terminates in a hand grip portion 48. The upper portion 38 of the frame tube 28 is surmounted by a seat assembly 50 which is adapted to support the user and which is typically made from a unicycle seat or the like.

Figure 5:
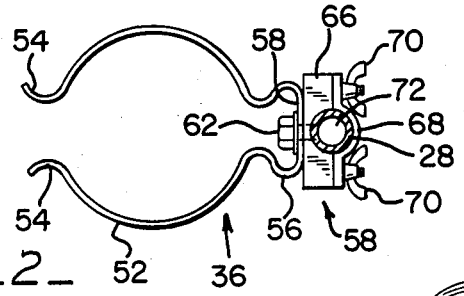
FIG. 5 is an enlarged view, partly in plan and partly in horizontal section, taken along lines 5—5 of FIG. 3, showing the leg clip portion of the apparatus.

Referring now to constructional details, certain subassemblies of the invention, FIG. 5 shows that the leg clip assembly 36 includes a resilient leg receiver 52 in generally C-shaped form, and shown to be made from spring steel or the like. This clip 52 includes outer end portions 54 which are contoured so as to permit them to be readily spread apart to receive a leg therein. A radially inner portion 56 of the clip 52 is also in contoured form and includes a center section 58 adapted to be fixed by a bolt 62 or like to the clip support assembly 58. This assembly includes a clip mounting block 66 which is suitably tapped to receive the bolt 62 and a cover plate 68 held in place by two or more thumb screw assemblies 70.

Figure 4:
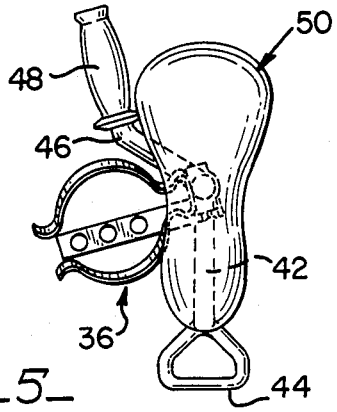
FIG. 4 is a top plan view of the appliance of FIGS. 2 and 3.

Accordingly, as shown, the cover plate 68 and body 66 define therebetween a frame-receiving center section 72 having a generally circular contour and adapted to clamp therebetween the frame tube 28. The thumb screws permit moving the leg clip either up or down, or radially, or both. Normally, this assembly 36 will be positioned as shown in FIG. 4 in such a way as to overlie the foot peg assembly 34 in an approximate position of vertical registration.

Figure 3:
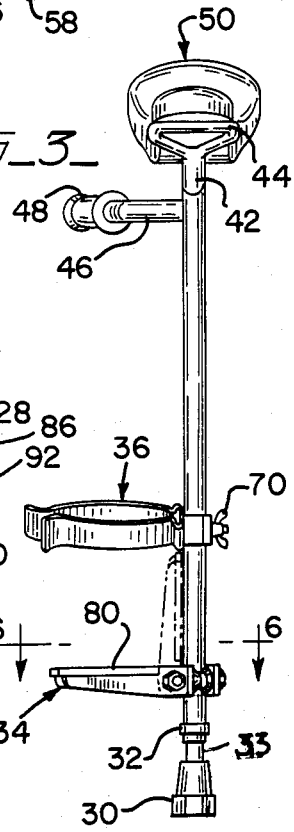
FIG. 3 is a front view of the appliance of FIG. 2.
Figure 6:
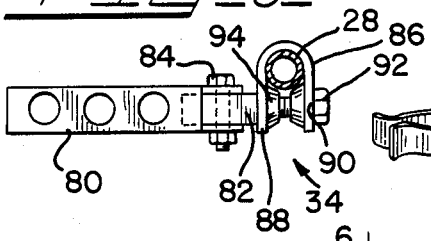
FIG. 6 is a view, partly in plan and partly in horizontal section, taken along lines 6—6 of FIG. 3, and showing the foot peg assembly of the invention.

Referring now to FIG. 6, the foot rest assembly 34 is shown in detail to include a footpeg portion 80, secured to an inner mount 82 by a nut and bolt assembly 84, permitting the two to pivot relative to each other. FIG. 3 shows the raised position of the footpeg 80 in phantom lines. The rest assembly 34 also includes a generally U-shaped clamp 86 having a pair of legs 88, 90 which are urged together by a bolt assembly 92. A pair of frusto-conical washer units 94 are arranged so that tightening the bolt 92 closes the bight of the U-shaped assembly 86 to engage the outer surface of the lower portion 32 of the tube 28. The footpeg assembly 34 is not novel per se and, accordingly, additional description thereof is not believed necessary; such foot rest assemblies may be purchased as original equipment or accessory item from motorcyle and bicycle shops.

Referring now to the use of the appliance of the invention, the injured person normally inserts the lower or ankle portion of his leg into the retainer clip 36 which is positioned just above the foot peg assembly 34. While seated, his ankle may rest upon the footpeg assembly, thus precluding it from bearing weight, while at the same time maintaining it in a raised position above the floor. Adjustment of the foot peg or foot rest position may be accomplished as described above.

Assuming the user to have an injured right leg, he is then supported by sitting on the seat or saddle and resting his left leg on the ground. When time for movement arrives, the user employs one or the other of his hands to manipulate the seat and frame assembly beneath him when he moves, coming to rest at the end of each step by again placing his full weight on the seat or saddle portion of the device. Accordingly, by using his healthy leg, such as his left leg, and upward force on his right arm, or downward force on his left arm, the user may easily move about from place to place. Various portions of the appliance may be adjusted to suit the size and shape of the user.

While not shown in detail in the preferred embodiment to be adjustable, it is apparent that the handle assemblies 40, 42 may also be made adjustable, as may be the height of the seat 50. Seat height adjustment means may be provided in the form of a clamp 32 (FIGS. 2 and 3), which cooperate with a reduced diameter stem 33 lying above the tip 32, the stem 33 is slidably received within the frame tube 28. By positioning the adjustment means adjacent the bottom appliance, the release between the seat and the handle is not disturbed. Such adjustment mechanisms not being novel per se, and being able to be accomplished by the provision of telescoping or like known mechanisms, further detailed description thereof is also omitted herefrom.

Additional advantages of the invention include the provision of a crtuch which is advantageous for use in crowded quarters wherein the excess width of conventional crutches can be disadvantageous.

Referring to the use of the inventive crutch on the stairs, the user can use one hand on the stair hand rail both to help him raise or lower his own weight, and to achieve stability. The crutch permits the user to traverse stairways by using his hands for increased safety and to do so at a greater weight while holding on to the stair hand rail. These advantages are particularly helpful for persons in a weakened condition. By a single unit rather than a two piece unit, the crutch provides improved mobility and convenience. Specifically, there is always an arm free to open or close doors, etc. Because of its reduced height or length, and since there is only a single unit, temporary storage is more convenient than with a pair of crutches, which are difficult to deal with in pairs as in entering or leaving an automobile, etc. The crutch of the invention is safer than conventional cructhes since the weight is applied to the floor or other traveled surface directly beneath the user rather than to the side, front or rear of the user. The single joint contact provides an improved grip on the traveled surface. In some cases, the need for an extra heavy or weight bearing cast can be eliminated if other considerations, such as the place of the injury, permit. Persons achieving skill in the use of the device may be able to manipulate it without using the foot peg or clip in some cases.

It will thus be seen that the present invention provides an improved orthopedic appliance which provides great mobility, low cost, light weight and makes it possible for the user to be employed in an occupation requiring a wide range of movements without sacrificing the protection necessary to give the temporarily or permanently injured limb or other body part the support required for maintenance or improvement of such condition.

It will thus be seen that the present invention provides an improved orthopedic assembly having a number of advantages and characteristics including those referred to above and others which are inherent in the invention.

A preferred embodiment of the invention having been described by way of example, it is anticipated that variations to the described form of invention will occur to those skilled in the art and that such modifications and variations may be made without departing from the spirit of the invention or the scope of the appended claims.

I claim:

1. An orthopedic appliance assembly adapted to support the body of an injured or handicapped person without the use of his arms and hands and adapted to be readily movable with the person, said assembly comprising, in combination, a principal frame assembly having a lower portion adapted to engage and rest upon a travelled surface in position of use, a seat assembly disposed at the other end of said frame and forming body support means for said person, at least one handle extending radially outwardly from said frame and spaced downwardly apart from said seat assembly, said handle having a gripping portion being positioned relative to said frame so as to be able to be grasped by said person so as to exert a lifting force on said appliance while said person is supported by said seat, said handle including means preventing movement of said gripping portion thereof above the level of said seat.

2. An orthopedic appliance assembly as defined in claim 1 which further includes a second handle extending outwardly from said frame, said second handle being spaced angularly apart from said first handle by at least 90° when said appliance is viewed along an axis parallel to the axis of said frame.

3. An appliance as defined in claim 1 which further includes means adapted to support a portion of the lower limb of said person, said limb support means being affixed to and extending radially outwardly from a lower portion of said frame assembly.

4. An orthopedic appliance assembly as defined in claim 3 wherein said limb support means comprises a foot rest assembly having a footpeg portion and a clamp portion, said clamp portion being affixed to said frame and said peg portion being pivotally attached to said clamp portion.

5. An orthopedic appliance assembly as defined in claim 3 wherein said limb support means is adjustably positionable relative to said frame.

6. An orthopedic appliance assembly as defined in claim 1 which further includes a clip assembly adapted to releasably engage a portion of the lower limb of said person, said clip being affixed to said frame in a position spaced just above said lower portion of said frame assembly.

7. An orthopedic appliance assembly as defined in claim 1 which further includes means for adjusting said seat assembly so as to raise or lower the same.

8. An orthopedic appliance assembly as defined in claim 6 which further includes means for adjustably positioning said clip relative to said frame.

9. A crutch assembly adapted for use by an injured or handicapped person using said crutch and further adapted to permit the hands and arms of a user to be free while the of the user is supported on said assembly, said crutch assembly including, in combination, a frame assembly having a lower portion adapted to engage and rest upon a travelled surface in use, lower limb support means adjustably secured to a lower portion of said frame and having a limb support peg extending radially outwardly from said frame, a body support saddle disposed at the upper end of said frame assembly, first and second handles affixed to an upper portion of said frame beneath said saddle and extending radially outwardly therefrom, said handles being positioned on said frame so as to be able to be grasped by the user while said user is seated on said body support saddle, and a limb receiving clip adjustably affixed to a portion of said frame extending radially outwardly from said frame and adapted to encircle at least a portion of the limb of said user so as to removably secure said appliance and said limb together, to facilitate simultaneous movement of said limb and crutch assembly while the user is moving about and being supported by said crutch assembly.

10. A crutch assembly as defined in claim 9 wherein said clip comprises a generally C-shaped clamp made from stiff but resilient sheet stock, said clip being adapted, to encircle the upper leg portion of said crutch assembly user.

11. A crutch assembly as defined in claim 10 wherein said saddle unit is adjustably affixed to said frame, whereby the height of said saddle may be adjusted in use.

* * * * *